United States Patent [19]

Morimoto et al.

[11] Patent Number: 5,066,885

[45] Date of Patent: Nov. 19, 1991

[54] INDIRECTLY HEATED FILAMENTARY CATHODE

[75] Inventors: Kiyoshi Morimoto; Shigeo Itoh; Takeshi Tonegawa; Takahiro Niiyama, all of Mobara, Japan

[73] Assignee: Futaba Denshi Kogyo Kabushiki Kaisha, Mobara, Japan

[21] Appl. No.: 343,366

[22] Filed: Apr. 26, 1989

[30] Foreign Application Priority Data

Apr. 30, 1988 [JP] Japan ..... 63-108815

[51] Int. Cl.[5] ..... H01J 1/24

[52] U.S. Cl. ..... 313/340; 313/27

[58] Field of Search ..... 313/340, 341, 345, 337, 313/27

[56] References Cited

U.S. PATENT DOCUMENTS 2,075,122 3/1937 Loewe et al. ..... 313/340

3,206,329 9/1965 Hickle ..... 313/340

4,100,449 7/1978 Gange ..... 313/340

FOREIGN PATENT DOCUMENTS 0206737 9/1987 Japan ..... 313/27

*Primary Examiner*—Donald J. Yusko

*Assistant Examiner*—Diab Hamadi

*Attorney, Agent, or Firm*—Oblon, Spivak, McClelland, Maier & Neustadt

[57] ABSTRACT

An indirectly heated filamentary cathode capable of significantly reducing its resistance, uniformly emitting electrons therefrom and effectively elminating its insulation failure. In the filamentary cathode, a cathode substrate is constituted by a metal conductive layer of a cylindrical shape arranged so as to be contacted with and electrically insulating layer and a fine metal wire wound which are closely contacted together, so that an electron emitting layer may be deposited through the metal conductive layer on the electrically insulating layer.

1 Claim, 2 Drawing Sheets

INDIRECTLY HEATED FILAMENTARY CATHODE

BACKGROUND OF THE INVENTION

1. Field of the Invention

This invention relates to an indirectly heated filamentary cathode, and more particularly to an indirectly heated filamentary cathode used in a fluorescent luminous device adapted to impinge electron emitted from a cathode on a phosphor-coated anode for luminescence, such as, for example, a fluorescent display tube, a flat type fluorescent luminous tube, a flat type fluorescent luminous device driven at a high voltage, or the like.

2. Description of the Prior Art

A fluorescent luminous device which has been conventionally used in the art generally includes an envelope of a box-like shape constituted by a substrate made of a glass plate, side plates vertically arranged on a periphery of the substrate and a front cover arranged opposite to the substrate through the side plates which are sealedly bonded together by a sealing material. The so-formed envelope is then evacuated to a high vacuum, in which electrodes such as anodes, control electrodes, filamentary cathodes are arranged.

The anodes comprises an anode conductor provided on an inner surface of the substrate and phosphor layers deposited on a surface of the anode conductor.

The control electrodes are disposed above the anodes as required, and the filamentary cathodes are stretchedly arranged the control electrodes.

In the conventional fluorescent luminous device thus constructed, when the filamentary cathodes are heated, electrons or thermions are emitted from the filamentary cathodes. Then, the control electrodes accelerate the electrons and control passing of the electrons therethrough, so that the electrons may be impinged on the phosphor layers of the anodes, resulting in the phosphor layers emitting light.

The filamentary cathode functioning as an electron source of the fluorescent luminous device is generally divided into two types. One is a directly heated filamentary cathode comprising a heating core wire having an oxide material coated thereon so as to serve as an electron emitting material and the other is an indirectly heated filamentary cathode comprising a heating core wire having an electrically insulating layer coated thereon and a conductive cathode substrate arranged on a surface of the electrically insulating layer and having an electron emitting layer made of an electron emitting material and provided thereon.

A conventional indirectly heated filamentary cathode which is considered to be pertinent to the present invention is disclosed in Japanese Patent Application Laying-Open Publication No. 206737/1987 (Japanese Patent Application No. 48274/1986) which was filed by the assignee.

The conventional indirectly heated filamentary cathode disclosed is generally constructed in such a manner as shown in FIGS. 4 and 5. More particularly, it includes a heating core wire 1 made of tungsten into an outer diameter as small as about 5 to 50 μm. On the core wire 1 is coated a heat-resistant electrically-insulating layer 2, which is formed of aluminum oxide into a thickness of about 1 to 50 μm by dipping or electrodeposition.

On the electrically insulating layer 2 is wound a fine metal wire 4 in a coiled manner so as to function as a cathode substrate for the filamentary cathode. The fine metal wire 4 has an outer diameter of several to several tens μm and winding of the wire 4 causes it to serve to protect and reinforce the electrically insulating layer 2, as well as act as the cathode substrate due to application of cathode voltage thereto. Accordingly, metals used for the metal wire 4 include electrically-conductive and heat-resistant metals such as, for example, nickel, tungsten, tantalum, rhenium, rhenium-tungsten alloy and the like.

On the fine metal wire 4 is coated an electron emitting layer 5 made of an electron emitting material capable of emitting thermions therefrom.

In the conventional indirectly heated cathode constructed as described above, an area of the cathode substrate can be increased by reducing a pitch at which the fine metal wire 4 is wound. However, an increase in the number of windings causes a length of the fine metal wire 4 to be wound to be increased, resulting in a resistance of the metal wire 4 being increased. Arrangement of the indirectly heated filamentary cathode of such an increased length in a fluorescent display device leads to a large potential gradient between both ends of the fine metal wire 4. This causes a gradient to occur in a potential of the cathode with respect to an anode, resulting in generation of a gradient in luminescence of a phosphor layer.

A decrease in length of the fine metal wire 4 by increasing a pitch between windings of the wire 4 causes the electron emitting layer 5 to be deposited on only the fine metal wire 4, resulting in the deposition of the layer 5 on portions of the electrically insulating layer 2 between the windings of the wire 4. This leads to a reduction of the electron emitting layer 5, to thereby decrease discharge of electrons from the layer 5. Such construction fails to uniformly transmit heat from the heating core wire 1 to the thermion emitting material layer 5 to cause the distribution of a temperature on the layer 5 to be non-uniform, so that the layer fails to uniformly emit electrons or thermions therefrom.

Further, the electrically insulating layer 2 is formed by coating particles of aluminum oxide on the heating core wire 1 and sintering them, so that the particles aggregate together. This causes the electrically insulating layer 2 to be porous or a number of pin holes to be formed in the layer 2. Unfortunately, such formation of the pin holes causes the electron emitting material to enter the pin holes, accordingly, arrangement of the filamentary cathode in the fluorescent display device leads to an insulation failure of the electrically insulating layer 2 due to contact between the heating core wire 1 and the electron emitting material.

SUMMARY OF THE INVENTION

The present invention has been made in view of the foregoing disadvantage of the prior art.

Accordingly, it is an object of the present invention to provide an indirectly heated filamentary cathode which is capable of significantly reducing a resistance between both ends thereof.

It is another object of the present invention to provide an indirectly heated filamentary cathode which is capable of uniformly emitting electrons therefrom.

It is a further object of the present invention to provide an indirectly heated filamentary cathode which is capable of effectively eliminating its insulation failure.

In accordance with the present invention, an indirectly heated filamentary cathode is provided. The indirectly heated filamentary cathode includes a heating core wire, an electrically insulating layer arranged for covering said heating core wire, a cathode substrate provided on said electrically insulating layer and an electron emitting layer provided on said cathode substrate. The cathode substrate is constituted by a metal conductive layer and a fine metal wire.

The metal conductive layer and fine metal wire constituting the cathode substrate may be arranged with the metal conductive layer being on the electrically insulating layer and the fine metal wire then being wound on the metal conductive layer. Alternatively, the fine metal wire and metal conductive layer constituting the cathode substrate may be wound on the electrically insulating layer and arranged on the fine metal wire and electrically insulating layer, respectively.

BRIEF DESCRIPTION OF THE DRAWINGS

These and other objects and many of the attendant advantages of the invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENTS

Now, an indirectly heated filamentary cathode according to the present invention will be described hereinafter with reference to FIGS. 1 to 3.

Figure 1:
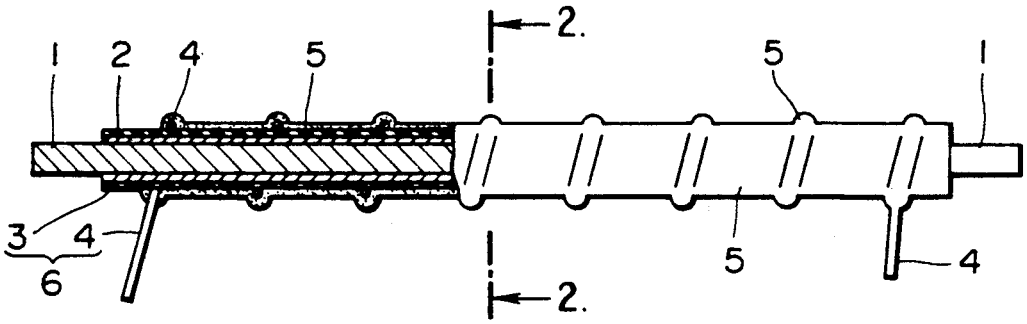
FIG. 1 is a front elevation view partly in section showing an embodiment of an indirectly heated filamentary cathode according to the present invention.
Figure 2:
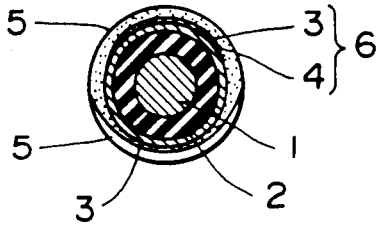
FIG. 2 is a sectional view taken along line II—II of FIG. 1.

FIGS. 1 and 2 show an embodiment of an indirectly heated filamentary cathode according to the present invention.

An indirectly heated filamentary cathode of the illustrated embodiment includes a heating core wire 1 which comprises a fine metal wire having an outer diameter of about 5 to 50 μm. The heating core wire 1 may be made of a suitable metal material such as tungsten, molybdenum, tantalum, rhenium-tungsten or the like. In the illustrated embodiment, it is made of tungsten into an outer diameter of about 50 μm. The heating core wire 1 has a heat-resistant electrically-insulating layer 2 made of, for example, particles of aluminum oxide according to any suitable method such as dipping, electrodeposition based on electrophoresis, or the like. The electrically insulating layer 2 has a thickness determined between 10 μm and 50 μm. In the illustrated embodiment, the layer 2 is formed into a thickness of 20 μm.

Then, the heating core wire 1 formed thereon with the electrically insulating layer 2 is heated in a reducing atmosphere to subject the aluminum oxide particles to sintering, resulting in the layer 2 being firmly deposited on the core wire 1.

A material for the electrically insulating layer 2 is not limited to the above-described aluminum oxide. It may be made of silicon oxide, ceramics or the like.

The electrically insulating layer 2 as subjected to sintering has an uneven surface because it is formed of fine particles. Also, it has a thickness as small as 20 μm. Such structure of the electrically insulating layer 2 causes pin holes to be formed therein. Thus, formation of a metal conductive layer 3 directly on the electrically insulating layer 2 leads to short-circuit between the metal conductive layer 3 and the heating core wire 1, resulting in an insulation failure.

In order to avoid such a problem, an intermediate film material is charged onto the electrically insulating layer 2 and dried, so that a uniform intermediate film layer exhibiting insulating properties may be formed on an upper surface of the electrically insulating layer 2. Subsequently, the metal conductive layer 3 is formed on the intermediate film layer, to thereby eliminate the insulation failure described above.

The intermediate film layer may be made of an organic material which has the following characteristics:

(1) Characteristics as an organic compound which takes the form of a liquid or paste before application and the form of a film after drying, and evaporates without leaving any residue or leaves only a residue of insulating properties by evaporation when it is burned;

(2) Characteristics as an organic or polymeric compound which chemically reacts with or adheres to the surface of the electrically insulating layer 2 to form a firm organic film;

(3) Characteristics as an organic compound which provides, on the surface of the intermediate film layer, an organic functional group functioning to catch an ion of tin, palladium or silver serving as a catalyst for electroless plating; and (4) Characteristics as an organic compound which permits the intermediate film layer to exhibit stable adhesion in an acidic or alkaline plating bath.

In the illustrated embodiment, γaminopropyl triethoxy silane (hereinafter referred to as "amino silane") is used as an organic compound which is capable of meeting the above-described characteristics. As is apparent from a chemical formula of amino silane or $NH_2C_3H_6Si(OC_2H_5)_3$, it has an amino group ($NH_2$) capable of absorbing palladium thereon Amino silane is dissolved in an organic solvent to form a liquid of a low viscosity and then the heating core wire 2 formed thereon with the electrically insulating layer 2 is dipped in the liquid to fill any recesses and pin holes of the layer 2 with the liquid. Thereafter, the wire 2 is dried at a temperature of 100° to 150° C. to vaporize the organic solvent, resulting in the intermediate film layer being formed.

Then, the metal conductive layer 3 and a fine metal wire 4 which cooperate together to constitute a cathode substrate are arranged. This may be carried out by either providing the metal conductive layer 3 on the intermediate film layer prior to arrangement of the fine metal wire 4 or providing the fine metal wire 4 on the intermediate film layer prior to the metal conductive layer 3. The following description will be made in connection with arrangement of the metal conductive layer on intermediate film layer by plating prior to arrangement of the fine metal wire. For this purpose, electroless plating is used to form the metal conductive layer 3 of nickel on the intermediate film layer. First, palladium is absorbed on the intermediate film layer as a pretreatment for the electroless plating.

For this purpose, an aqueous solution of palladium acetate is prepared and the heating core wire 1 formed thereon with the intermediate film layer is dipped in the solution to chemically absorb palladium on amine silane.

Then, electroless plating of nickel takes place, so that a nickel film of a thickness as small as 0.1 to 5 μm may be formed, resulting in the metal conductive layer 3 formed with fine pin holes being arranged.

Subsequently, the heating core wire 1 thus provided thereon with the metal conductive layer 3 is subjected to firing at 300° to 500° C. in an ambient atmosphere to burn and/or decompose amino silane forming the intermediate film layer and outwardly release it through the pin holes of the metal conductive layer 3. Silicon (Si) contained in amino silane is left in the form of a residue because it fails to evaporate. However, it does not adversely affect the electrically insulating layer 2 because it inherently possesses insulating properties. Also, Palladium likewise does not deteriorate the insulating properties of the electrically insulating layer 2 because it is completely taken in the plated nickel layer. Such burning and decomposition of the intermediate film layer causes the metal conductive layer 3 to be contacted with only projecting portions of the insulating layer 2.

An increase in thickness of the metal conductive layer may be carried out by electroless plating or electrolytic plating of nickel after decomposition of the intermediate film layer.

Electroless plating of nickel has been described in connection with formation of the metal conductive layer 3. However, it may be formed by any other suitable method such as vacuum deposition, ion plating, sintering of metal after dipping, or the like which has been widely practiced for the formation of a film.

Then, on a surface of the metal conductive layer 3 is wound the fine metal wire 4 of several to several tens μm in outer diameter in a coiled manner, so that it cooperates with the metal conductive layer 3 to constitute a cathode substrate 6. In the illustrated embodiment, the fine metal wire 4 plays three parts or acts as a lead conductor for the cathode substrate 6, the cathode substrate 6 itself and means for protecting and reinforcing the metal conductive layer 3.

Arrangement of the fine metal wire 4 on the electrically insulating layer 2 prior to the metal conductive layer 3 facilitates protection of the electrically insulating layer 2 and the plating.

The fine metal wire 4 is preferably formed of a material having properties required for the cathode substrate 6 such as, for example, a material which is capable of reducing oxide of alkaline earth metal used for an electron emitting material described hereinafter to liberate metal.

More specifically, a tungsten wire which may be used for the heating core wire 1 likewise may be used for fine metal wire 4, because it serves as a reductant. Nickel likewise may be suitably used for this purpose. However, nickel doped with a reducing material such as magnesium, silicon, aluminum or the like in an amount of 0.01 to 0.2% may be more suitably used as metal for the cathode substrate 6. Further, tantalum, rhenium and the like likewise may be used.

Figure 3:
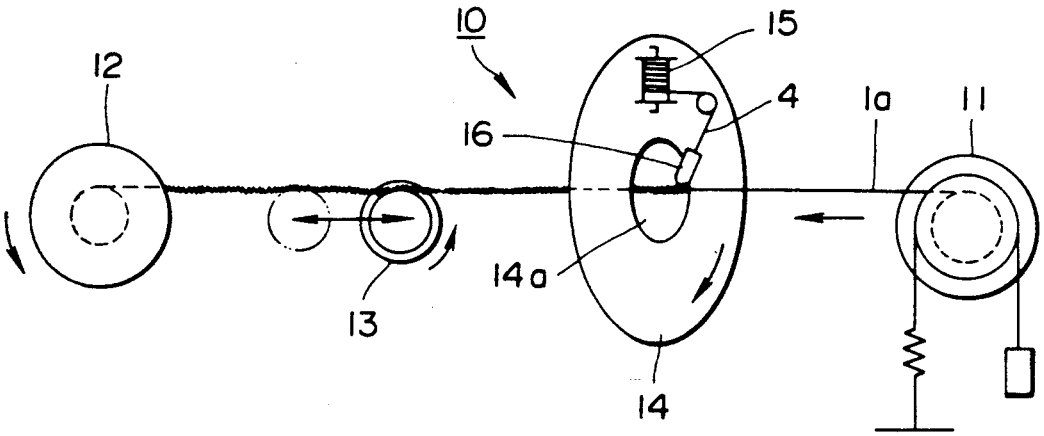
FIG. 3 is a schematic view showing a coil winding apparatus for winding a fine metal wire into a coiled shape.
Figure 4:
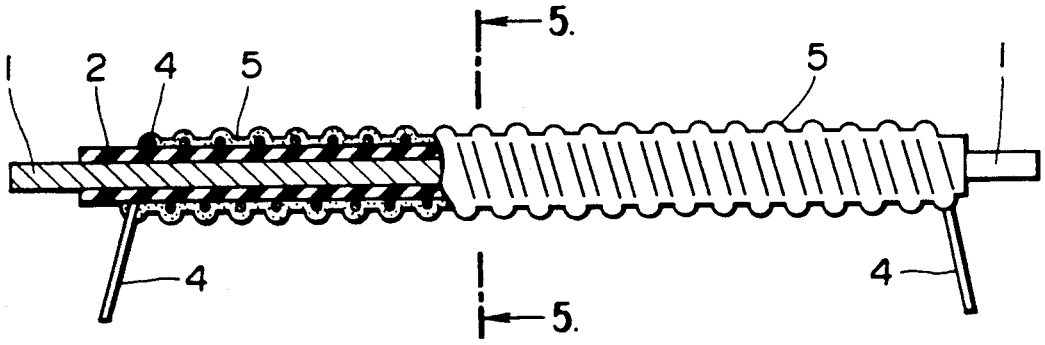
FIG. 4 PRIOR ART
FIG. 4 is a front elevation view partly in section showing a conventional indirectly heated filamentary cathode.
Figure 5:
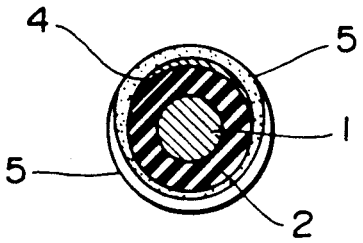
FIG. 5 PRIOR ART
FIG. 5 is a sectional view taken along line V—V of FIG. 4.

Winding of the fine metal wire 4 on the metal conductive layer 3 may be carried out using such a winding apparatus 10 as shown in FIG. 3. More particularly, a heating core wire 1*a* formed thereon with a insulating layer 2 and a metal conductive layer 3 is drawn out from a wire spool of the apparatus 10, fed by a feed roller 13 and then taken up on a take-up spool 12. Between the spool 11 and the feed roller 13 is arranged an annular disc 14 which is provided thereon with a bobbin 15 and a nozzle 16 for a fine metal wire 4. The core wire 1*a* is passed through an aperture 14*a* of the disc 14, during which the disc 14 is rotated at a high speed to cause the fine metal wire 4 to be wound on the core wire 1*a*. A pitch at which the fine metal wire 4 is wound on the core wire la may be controlled as desired. Dense winding of the wire 4 at a small pitch causes an increase in adhesion of an electron emitting layer 5 formed of an electron emitting material capable of emitting thermions therefrom, as well as increases the cathode substrate 6. Winding of the fine metal wire 4 at a large pitch permits the winding operation to be rapidly accomplished.

Thereafter, the electron emitting layer 5 is formed on the cathode substrate 6. The electron emitting layer 6 is made of a solid solution of oxide of alkaline earth metals capable of satisfactorily emitting thermions at a temperature of 500° to 700° C. and deposited on the cathode substrate 6 by electrodeposition. More particularly, carbonate of alkaline earth metals such as barium, strontium, calcium and the like is added to an organic solvent to which a binder is added in a small amount to form a suspension. Then, the core wire 1*a* on which the fine metal wire 4 is wound is dipped in the suspension. A voltage is applied across the core wire 1*a* while the fine metal wire 4 is connected to a cathode side and a counter electrode is connected to an anode side, so that the carbonate may be adhered onto the cathode substrate. Then, the the core wire 1*a* is arranged in a fluorescent luminous device after the so-adhered carbonate is dried. Thereafter, an envelope of the device is evacuated and a current is flowed through the core wire 1*a* to heat it. This causes thermal decomposition of the carbonate, to thereby form a solid solution of oxide of alkaline earth metals or barium, strontium and calcium (Ba, Sr, Ca)O, resulting in the indirectly heated filamentary cathode.

The so-made indirectly heated filamentary cathode of the illustrated embodiment is stretched in such a manner that the heating core wire 1 is attached to an anchor and a support and stretchedly supported on the anchor and support while setting it at a predetermined height and stretching it. Connection to the cathode substrate 6 is simply carried out by connection to the fine metal wire 3, thus, a necessity for arrangement of a separate lead wire is eliminated.

The manner of driving of a fluorescent luminous device in which the indirectly heated filamentary cathode of the illustrated embodiment constructed as described above is arranged will be described hereinafter.

A current is flowed through an external terminal connected to the support for the heating core wire 1 to drive it, resulting in heating the cathode substrate 6 to a temperature of 500° to 700° C., and concurrently a cathode voltage is applied across the fine metal wire 4. This results in electrons or thermions being emitted from the electron emitting layer 5 of the cathode. The so-emitted electrons are accelerated and selectively controlled by control electrodes of the fluorescent luminous device and then impinged on phosphor layers on an anode conductor of the device, so that the phosphor layers may emit light.

As described above, in the indirectly heated cathode of the illustrated embodiment, the heating core wire 1 and the cathode substrate 6 are insulated from each other by the electrically insulating layer 2, so that even use of a D.C. current for heating the cathode does not adversely affect a potential of the cathode substrate, to thereby keep the potential uniform. Thus, it will be noted that the cathode of the embodiment exhibits uniform luminescence along its length.

In addition to the embodiment described above, the present invention may be so embodied that the cathode substrate may be constituted by the fine metal wire wound on the electrically insulating layer and the metal conductive layer arranged on both the fine metal wire and electrically insulating layer.

More particularly, in such an embodiment, coating of an electrically insulating layer 2 on a heating core wire 1 and formation of an intermediate film layer on the insulating layer 2 take place as in the above-described embodiment. On the intermediate film layer is wound a fine metal wire 4 using the winding apparatus shown in FIG. 3. Then, a metal conductive layer 3 is deposited on portions of the electrically insulating layer 2 between windings of the fine metal wire 4. Thereafter, an electron emitting layer 5 is arranged on the metal conductive layer 3.

As can be seen from the foregoing, in the indirectly heated filamentary cathode of the present invention, the cathode substrate is constituted by the metal conductive layer of a cylindrical shape arranged so as to be contacted with the electrically insulating layer and the fine metal wire wound. Such construction of the present invention exhibits the following advantages.

The conventional filamentary cathode, as described above, is so constructed that the fine metal wire is wound directly on the electrically insulating layer and the electron emitting layer is applied onto the fine metal wire. Such construction of the prior art causes the material for the electron emitting layer to be coated on portions of the electrically insulating layer between the windings of the fine metal wire. This often results in the material reaching the heating core wire through the pin holes of the insulating layer to lead to a insulation failure. On the contrary, in the present invention, the electron emitting layer is deposited through the cylindrical metal conductive layer on the electrically insulating layer, to thereby effectively prevent the material for the electron emitting layer from reaching the heating core wire.

Also, in the present invention, the cathode substrate comprises the metal conductive layer and the wound fine metal wire which are positively contacted together. Such construction permits a resistance between both ends of the indirectly heated filamentary cathode to be significantly decreased to a degree sufficient to prevent an ingredient from occurring in luminance of a fluorescent luminous device.

Further, the electron emitting layer is deposited on the portions of the metal conductive layer between the windings of the fine metal wire as well as on the fine metal wire. alternatively, it is uniformly deposited on the metal conductive layer. This permits electrons to be uniformly emitted from the whole filamentary cathode, to thereby improve an electron emitting efficiency.

Moreover, in the present invention, the electrically insulating layer is protected by the metal conductive layer or fine metal wire, so that damage of the electrically insulating layer such as peeling, breakage or the like during manufacturing of the cathode may be minimized or substantially prevented.

While preferred embodiments of the invention have been described with a certain degree of particularity with reference to the drawings, obvious modifications and variations are possible in the light of the above teachings. It is therefore to be understood that within the scope of the appended claims, the invention may be practiced otherwise than as specifically described.

What is claimed is:

1. An indirectly heat filamentary cathode comprising:

a heating core wire;

an electrically insulating layer for covering said heating core wire, said electrically insulating layer including a first layer formed of sintered aluminum oxide particles and a second layer formed of an intermediate film layer made of an organic material, said second layer being formed on the surface of said first layer so as to be placed on a part of said first layer;

a cathode substrate provided on said electrically insulating layer, said cathode substrate including metal conductive layer formed of electroless plating on the surface of said second electrically insulating layer and a fine metal wire; and an electron emitting layer provided on said cathode substrate.

* * * * *